United States Patent [19]

Della Torre

[11] 4,191,117

[45] Mar. 4, 1980

[54] METHOD AND APPARATUS FOR ATTACHING AN ELASTIC BAND TO A TUBULAR WORKPIECE

[75] Inventor: Giancarlo Della Torre, Biassono, Italy

[73] Assignee: Rockwell-Rimoldi, S.p.A., Milan, Italy

[21] Appl. No.: 879,299

[22] Filed: Feb. 21, 1978

[30] Foreign Application Priority Data

Mar. 3, 1977 [IT] Italy ..... 20844 A/77

[51] Int. Cl.[2] ..... D05B 23/00

[52] U.S. Cl. ..... 112/2; 112/121.26; 112/10; 112/141; 112/322; 112/121.15

[58] Field of Search ..... 112/2, 121.15, 121.26, 112/121.27, 121.29, 121.12, 10, 63, 305, 147, 141, 322

[56] References Cited

U.S. PATENT DOCUMENTS

| | | | |
|---|---|---|---|
| 1,723,781 | 8/1929 | Hoggard | 112/121.26 |
| 2,993,455 | 7/1961 | Baize | 112/10 X |
| 3,783,805 | 1/1974 | Guichard | 112/121.26 X |
| 3,865,058 | 2/1975 | Rovin et al. | 112/121.26 X |
| 4,046,087 | 9/1977 | Manetti | 112/121.26 X |
| 4,098,201 | 7/1978 | Adamski, Jr. et al. | 112/121.26 X |

*Primary Examiner*—H. Hampton Hunter

[57] ABSTRACT

An apparatus for use with a sewing machine having a frame for supporting a tubular workpiece that is movable between a workpiece loading station and the sewing area of the machine. The workpiece is supported under tension on the frame which includes a positioning element for locating it thereon and a folding element for folding one of its ends over an elastic band placed on the workpiece at a predetermined distance from the positioning element. Movement of the frame to the sewing area places the workpiece in position to receive a seam of stitches in the folded portion within which the elastic band is located.

6 Claims, 5 Drawing Figures

METHOD AND APPARATUS FOR ATTACHING AN ELASTIC BAND TO A TUBULAR WORKPIECE

BACKGROUND OF THE INVENTION

The present invention pertains to a sewing machine and more particularly to a method and apparatus operatively associated with the machine for attaching an elastic band to a tubular workpiece. Methods of applying an elastic band to a tubular workpiece are well known and usually involve the attachment of the band so that it is exposed or within a folded edge of the workpiece which is accomplished by utilization of appropriate folding guides.

More precisely, the folding of an edge of a workpiece is accomplished by a type of guide that requires constant attention on the part of the operator during the sewing cycle and in particular at the end of said cycle when the initial portion of the seam approaches the opening of the guide.

With the workpiece being of the tubular type, the seam is formed on a ring-like section which causes the initial portion of the seam to approach the guide during the latter part of the seaming cycle. To complete the seaming cycle, the operator must intervene so as to prevent the initial portion of the seam from entering the channel of the guide. This final operation is conducted with the garment completely free, and the success of the operation depends solely on the skill of the operator. This procedure requires what is considered an excessive loss of time due to the necessity of sewing intermittently so as to enable the operator to manually manipulate the edge of the workpiece. Careful attention is also required so as to orient the workpiece in the guide in order to obtain a uniform turning of the folded edge. An object of the present invention is to improve the sewing operation and to eliminate all previously required intervention on the part of the operator during the sewing operation. The technical problem to be solved is that of positioning the workpiece and the elastic band prior to the start of the sewing operation and to provide means for folding the edge of the workpiece onto the elastic band which will not require the use of manual-locking edge guides and which will permit the workpiece to be presented to the sewing area of the machine in readiness for sewing and without the need for further attention during the sewing cycle.

SUMMARY OF THE INVENTION

The solution to this problem involves a method in accordance with the present invention, which includes the following steps:

(a) placement of the workpiece onto a suitable tension device so as to locate the edge of the workpiece in contact with a positioning device;

(b) locating an elastic band on the tubular workpiece at a predetermined distance from the edge thereof;

(c) complete and synchronized folding onto the elastic band of that area of the workpiece intermediate said band and the edge of said workpiece; and (d) sewing of a complete seam on the folded portion of the workpiece.

To accomplish these method steps requires an apparatus that includes a tensioning device which includes two or more freely rotatably or driven rollers, a positioning element for engaging the edge of the tubular workpiece, which is operatively associated with each of said rollers. Additionally positioning elements are provided for the elastic band, which are operatively associated with each of said rollers and folding elements that engage a portion of the edge of the workpiece and which form an integral part of each of the positioning elements for the tubular workpiece. The folding elements are slightly spaced from each of their associated rollers and cooperate with each of the elastic band positioning elements to effect the folding of the workpiece edge onto the elastic band. The axes of rotation of at least two of the rollers are on the same plane as that of the work surface of the sewing machine.

These and other objects of the invention will become more fully apparent by reference to the appended claims and as the following detailed description proceeds in reference to the figures of drawing wherein:

DESCRIPTION OF THE PREFERRED EMBODIMENT

For a better understanding of the method provided by the present invention, the apparatus for effecting the abovementioned method steps will first be described.

Figure 1:
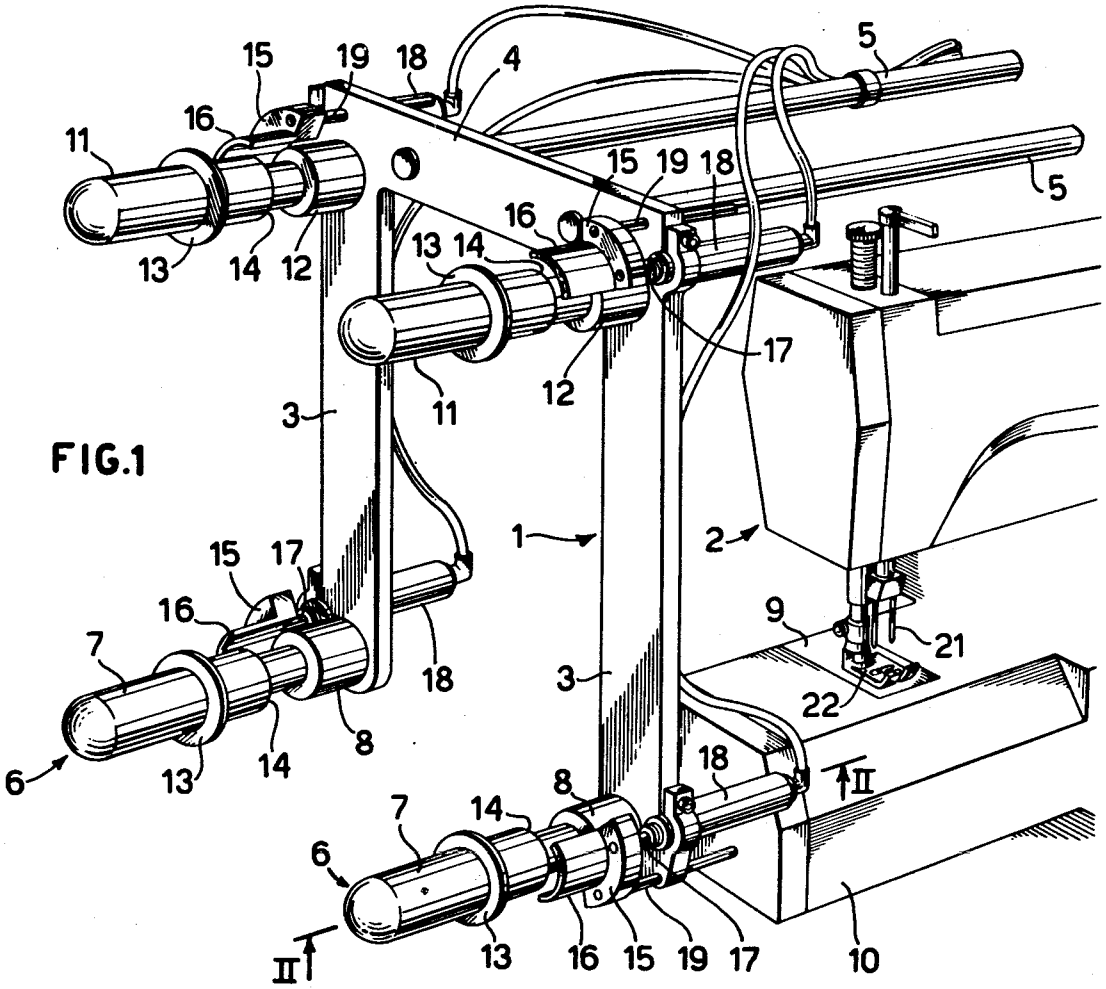
FIG. 1 is a perspective view showing the device according to the invention operatively associated with a sewing machine.

This apparatus includes a frame that is identified generally in FIG. 1 by numeral 1 and is slidably supported in operative association with a conventional sewing machine 2. The frame includes two vertically extending supports 3, disposed in spaced relation one from the other and which depend from a horizontal cross-bar 4.

The cross-bar 4 is supported by a pair of spaced and parallel guide rods 5 disposed above the sewing machine and are slidably mounted in any suitable structure not shown. The frame 1 includes a tensioning device 6 having a pair of rollers 7 that are rotatably mounted on the lower ends 8 of the vertical supports 3.

Either freely rotatably or driven rollers may be used without altering their intended function.

The axes of rotation of the two rollers 7 are parallel and they are disposed in a plane that is parallel to the work surface 9 of the sewing machine.

This arrangement is such that the two rollers 7 are separated one from the other by a distance greater than the width of the base 10 of the sewing machine, and are for all intents and purposes located at the same height as the work surface 9.

In order to stretch and hold the tubular-type workpiece to be sewn, the tensioning device also includes two auxiliary rollers 11 which are rotatably mounted on the upper portions of the supports 3 that are identified in FIG. 1 by numeral 12.

The rollers 7 and 11 are disposed so as to form a quadrilateral that defines the pathway of the tubular garment as it is being sewn.

Each roller 7 and 11 is provided with a raised ring 13 that is fixed thereon at a predetermined distance from said rollers' inner ends 14 and serve to maintain tension on the workpiece so as to prevent displacement thereof during its subsequent rotation during sewing.

Positioning elements 15 for the tubular workpiece are also provided for each roller on the frame 1 and are mounted adjacent the end parts 8 and 12 of the supports 3.

More specifically these positioning elements 15 are slightly spaced from their respective rollers and define semicircular blocks which in their rest position are spaced from the inner ends 14 of their rollers by a distance equal to that portion of the workpiece which has to be folded with the elastic band interposed therebetween and which will be more fully described hereinafter.

Intermediate each positioning element 15 and its respective roller a folding element 16 is provided which defines an arcuated plate that extends parallel with and at location disposed radially from the outer surface of each roller. These arcuated plates form an integral part of each positioning element 15 and extend in a direction whereby their outer ends are disposed in close alignment with the inner ends 14 of the rollers.

The circumference of the arcuated plates is such that they subtend the inner end of each roller by an amount that is equivalent to the thickness of the workpiece that has been folded and which includes the elastic band.

Consequently, in the case of the preferred embodiment shown in the drawings, the maximum circumference of each arcuated plate is equal to a 90° angle.

Should a tensioning device having only two or three rollers be utilized, the maximum circumference would be equal to a 180° and a 120° angle respectively.

Each of the positioning elements 15 is fixed on the outer end of an actuating rod 17 of a pneumatic cylinder 18 that is mounted on the frame 1 and provides a means for effecting movement of the arcuated plates in a direction parallel with the axes of the rollers 7 and 11.

In the preferred embodiment the positioning elements 15 are formed integral with each arcuated plate with the drive mechanisms therefor consisting of separate pneumatic cylinders for each of said elements which are arranged so as to be simultaneously actuated. It should be understood, however, that the individual positioning elements could be operatively interconnected in a manner whereby they could be simultaneously actuated by a drive mechanism such as a single pneumatic cylinder. To prevent rotation of positioning element 15 and the arcuated plate about the axis of its cylinder 18, a guide rod 19 is provided which extends parallel to the actuating rod 17. This guide rod 19 has one end thereof fixed to the positioning element and extending from the latter it is freely slidable in an opening (not shown) provided in the support 3.

Figure 2:
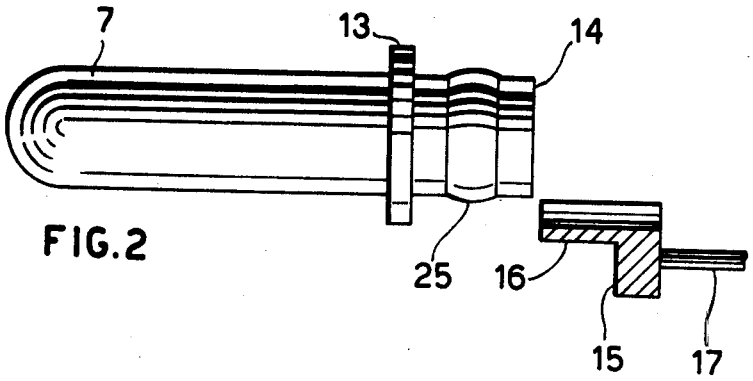
FIGS. 2, 3 and 4 are elevational views and partially in section taken along line II—II of FIG. 1, showing progressively the steps of effecting the folding of the workpiece edge on the elastic bands.
Figure 3:
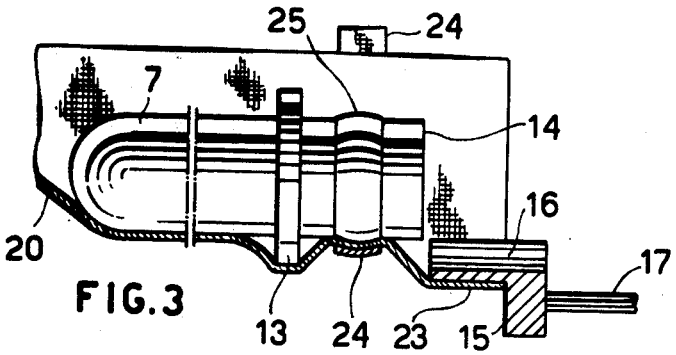
Figure 4:
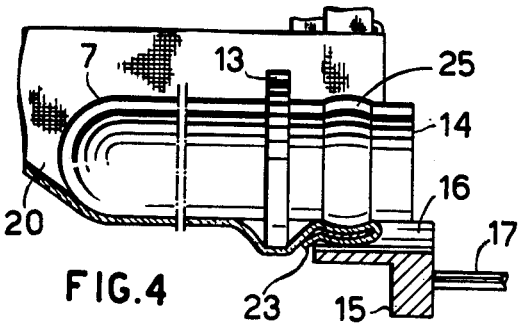
Figure 5:
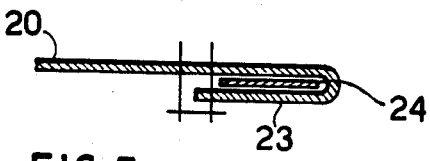
FIG. 5 is a sectional view of a portion of the workpiece showing the elastic band within the fold and in readiness for the seaming operation.

Referring now to FIGS. 2, 3 and 4 the method of applying an elastic band to a tubular workpiece by means of the apparatus described above first requires the manual placement of a workpiece 20 on the rollers 7 and 11 of the tension device 6 when the frame 1 is in loading position spaced from the sewing area of the machine. As is well known to those conversant in the art the sewing area is defined by the needle or needles 21 and the presser foot 22. The placement of the tubular workpiece must be such so that the portion depicted by numeral 23 is caused to engage the arcuate plates of the folding elements 16 and the semicircular blocks of the positioning elements 15. The next step is that of manually locating the elastic band 24 on the tubular workpiece so that it is positioned as shown in FIG. 3 between the rings 13 and the above-mentioned arcuated plates in a predetermined position that is characterized by a positioning member that defines a rounded rim 25 which among other things is effective in preventing the elastic band 24 from being displaced along the rollers as they are caused to rotate during the sewing cycle.

The minimal width of the rounded rim 25 is substantially the same as the width of the elastic band and it is preferable that the width of said rim be essentially equal to the minimal width of the elastic bands that are normally used.

At this point the portion of the workpiece intermediate the elastic band and the edge engaging the positioning elements 15 is automatically folded over said elastic band. This function is carried out by activating, by any suitable means not shown, the pneumatic cylinders 18 which together effect movement of the arcuated plates and positioning elements 15 toward and in a plane parallel with the axes of roller 7 and 11.

More specifically and as more clearly shown in FIG. 4, this movement of the arcuated plates causes that portion of the garment in contact with said plates to be folded over the elastic band.

This operation is also made possible by the fact that the elastic band is the element that maintains the workpiece in position on the rollers during movement of the arcuated plates.

The folding function described occurs along the entire edge of the tubular workpiece.

Upon completion of the folding function the arcuate plates are returned to their initial position, and the workpiece is then moved on the frame 1 into the sewing area beneath the presser foot 22 in order to be sewn. The frame 1 is adapted to move with the guides 5 from a loading position spaced from the machine to the sewing position. Obviously, the turning phase that takes place when the frame is moved towards the machine, as well as the displacement phase and also the starting or stopping of the machine, follows one after the other in an automatic cycle.

Although the present invention has been described in connection with a preferred embodiment it is to be understood that modifications and variations may be resorted to without departing from the spirit and scope of the invention as those skilled in the art will readily understand. Such modifications and variations are considered to be within the purview and scope of the invention and the appended claims.

We claim:

1. An apparatus for folding one end of a tubular workpiece over an elastic band and sewing the same therebetween in a sewing machine having a stitch forming needle and presser foot defining the sewing area thereof, said apparatus comprising:

(a) a frame (1) operatively associated with the sewing machine and movable between positions of a workpiece loading station spaced from the machine and the sewing area thereof;

(b) a tensioning device (6) mounted on said frame which includes:

(i) at least two rollers (7) for engaging the inner surface adjacent one end of the tubular workpiece;

(ii) a positioning element (15) slidably mounted on said frame (1) adjacent each of said rollers for engaging the end of the workpiece;

(iii) means defining a folding element (16) attached to said positioning element(15);

(iv) means forming a part of each roller defining a location for positioning an elastic band on the workpiece; and (v) actuating means for simultaneously moving said positioning and folding elements from a rest position toward and parallel with the axes of said rollers to effect folding the end of the workpiece over the elastic band.

2. The apparatus according to claim 1 wherein each of said rollers (7) includes a raised ring (13) fixed on and intermediate the ends thereof for maintaining tension on the workpiece while moving about said rollers during the sewing operation.

3. The apparatus according to claim 1 wherein said folding element (16) defines an arcuated plate extending from said positioning element (15) and radially spaced from its respective roller a distance corresponding to the thickness of the folded end of the workpiece with the elastic band disposed therebetween.

4. The apparatus according to claim 1 wherein said positioning means defines a rounded rim (25) having a width substantially the same as the elastic band.

5. The apparatus according to claim 1 wherein said positioning element (15) defines a semi-circular block which in its rest position is spaced from its respective roller (7) by a distance corresponding to the width of that portion of the workpiece to be folded over the elastic band.

6. The apparatus according to claim 1 wherein said actuating means includes a pneumatic cylinder (18) operatively connected to each positioning and folding elements.

* * * * *